US006591557B1

(12) United States Patent
Thomsen et al.

(10) Patent No.: US 6,591,557 B1
(45) Date of Patent: Jul. 15, 2003

(54) PANEL SYSTEM

(75) Inventors: Morten Werner Thomsen, Roskilde (DK); Hans Ove Pedersen, Vaerløse (DK); Lars Helmersen, Jyllinge (DK); Vagn Elnfeldt Jensen, Roskilde (DK); Aage Mathiassen Wind, Lynge (DK); Niels Birkedal Kristiansen, Copenhagen (DK)

(73) Assignee: VKR Holdings A/S, Søborg (DK)

( * ) Notice: Subject to any disclaimer, the term of this patent is extended or adjusted under 35 U.S.C. 154(b) by 0 days.

(21) Appl. No.: 09/959,342

(22) PCT Filed: Apr. 18, 2000

(86) PCT No.: PCT/DK00/00199

§ 371 (c)(1),
(2), (4) Date: Jan. 22, 2002

(87) PCT Pub. No.: WO00/65172

PCT Pub. Date: Nov. 2, 2000

(30) Foreign Application Priority Data

Apr. 23, 1999 (DK) ..... 1999 00556

(51) Int. Cl.[7] ..... E04B 7/02

(52) U.S. Cl. ..... 52/90.1; 52/82; 52/200; 52/235; 52/278; 52/460; 52/461; 52/463; 52/465; 52/506.07; 52/506.08; 52/DIG. 17; 49/71

(58) Field of Search ..... 52/506.07, 506.08, 52/235, 200, 460, 461, 463, 465, 278, DIG. 17, 82, 90.1; 49/71

(56) References Cited

U.S. PATENT DOCUMENTS 212,307 A * 2/1879 Friend ..... 52/395
412,313 A * 10/1889 Weis et al. ..... 454/198
2,642,018 A * 6/1953 Weber ..... 52/277
2,685,851 A * 8/1954 Zachman ..... 52/278
2,962,133 A * 11/1960 Kivett et al. ..... 411/437

(List continued on next page.)

FOREIGN PATENT DOCUMENTS

| | | |
|---|---|---|
| DE | 77 18 436 | 11/1977 |
| DK | 151116 B | 3/1981 |
| DK | 168161 B1 | 10/1986 |
| EP | 0 382 278 | 8/1990 |
| EP | 0 553 688 A2 | 8/1993 |
| EP | 0 619 403 A1 | 10/1994 |
| SE | 467115 | 5/1992 |
| WO | WO 86/05224 | 9/1986 |

OTHER PUBLICATIONS

Derwent's Abstract of SU 1094933.

*Primary Examiner*—Carl D. Friedman
*Assistant Examiner*—Christy Green
(74) *Attorney, Agent, or Firm*—Venable LLP; John P. Shannon; Chad C. Anderson

(57) ABSTRACT

The panel system is meant for construction of a panel fillet or a major panel surface to be mounted in a pitched roof or in a facade, comprising a number of fixed panels (1) together with a number of openable panels (2), each panel comprising a frame structure composed of frame members (13, 22) bordering a panelling element (32) between them, each frame member (13, 22) comprising a profile element (30) and at least a core element (35). The profile elements (30) are designed as uniform standard parts, and in that at least some frame members of the frame structure are provided with means to vary the moment of inertia, where the means can comprise at least one element (47) which is received in said core element (35) and which extend over essentially the entire length of the frame member.

15 Claims, 3 Drawing Sheets

Figure 1:
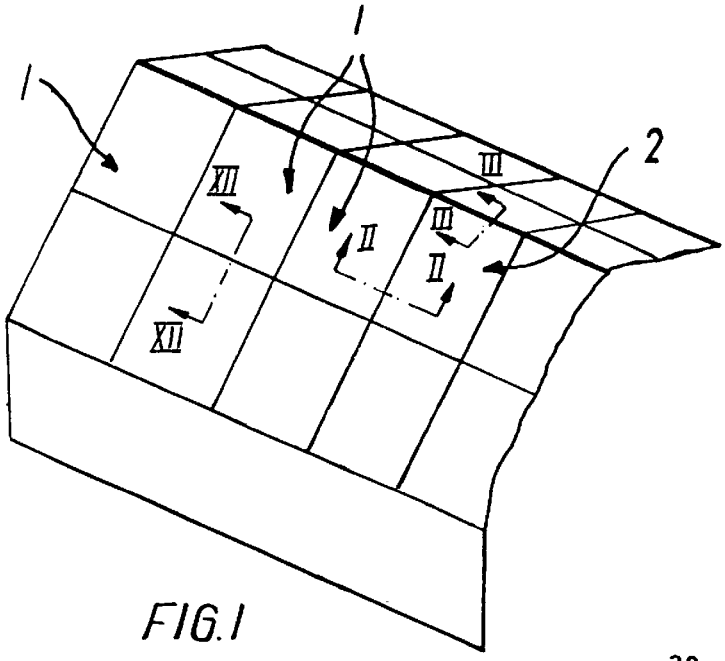

U.S. PATENT DOCUMENTS 3,150,463 A * 9/1964 Nearing et al. ..... 52/262
3,766,698 A * 10/1973 Dallen ..... 52/204.597
3,798,862 A * 3/1974 Stoakes ..... 52/204.591
3,940,893 A * 3/1976 Rausch et al. ..... 52/468
4,028,854 A * 6/1977 Diggs ..... 52/93.1
4,057,941 A * 11/1977 Schwartz ..... 47/17
4,069,627 A * 1/1978 Pegg ..... 52/204.599
4,070,806 A * 1/1978 Hubbard ..... 52/395
4,075,795 A * 2/1978 Thomas ..... 52/8
4,114,330 A * 9/1978 Sukolics ..... 52/200
4,175,361 A * 11/1979 Kumode ..... 52/66
4,188,764 A * 2/1980 Gode ..... 52/481.2
4,306,398 A * 12/1981 Duckett ..... 52/394
4,315,501 A * 2/1982 Ward ..... 126/623
4,395,862 A 8/1983 Jäger et al.
4,418,506 A * 12/1983 Weber et al. ..... 52/204.593
4,640,072 A * 2/1987 Muhle ..... 49/DIG. 1
4,648,231 A * 3/1987 Laroche ..... 24/459
4,663,896 A * 5/1987 Dunnick ..... 52/71
4,750,302 A * 6/1988 Bechtold ..... 52/72
4,843,791 A * 7/1989 Michlovic ..... 52/204.593
4,854,095 A * 8/1989 Michlovic ..... 52/204.591
4,976,076 A * 12/1990 Brown ..... 52/92.1
4,996,802 A * 3/1991 Brown ..... 52/92.2
4,998,389 A * 3/1991 Pritts ..... 52/90.1
5,074,089 A * 12/1991 Kemmer et al. ..... 52/14
5,209,031 A * 5/1993 Tavano ..... 52/92.2
5,330,386 A * 7/1994 Calandra ..... 454/341
5,363,615 A * 11/1994 Christopher et al. ..... 52/272
5,557,899 A * 9/1996 Dube et al. ..... 52/455
5,560,155 A * 10/1996 Back ..... 52/90.1
5,791,105 A * 8/1998 Gangi ..... 52/204.1
5,826,380 A * 10/1998 Wolfe ..... 52/90.1
6,119,410 A * 9/2000 Wolfe ..... 52/71
6,223,481 B1 * 5/2001 Rickman ..... 52/460
6,487,821 B1 * 12/2002 Thomsen et al. ..... 52/90.1

* cited by examiner

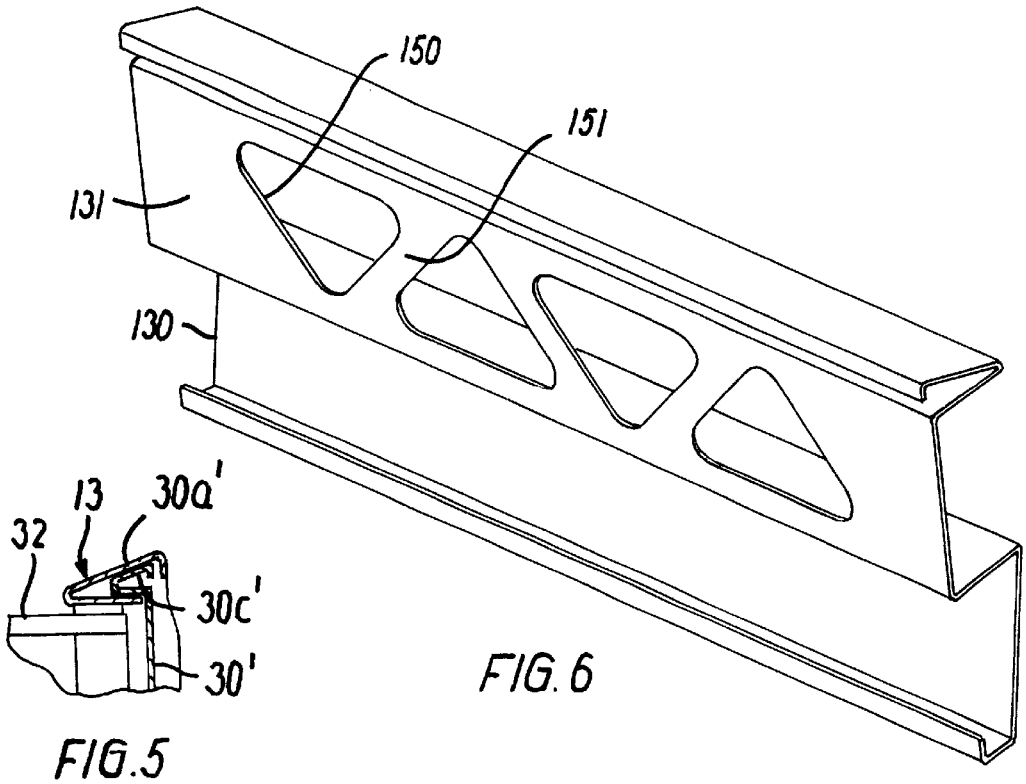
FIG. 6
FIG. 5
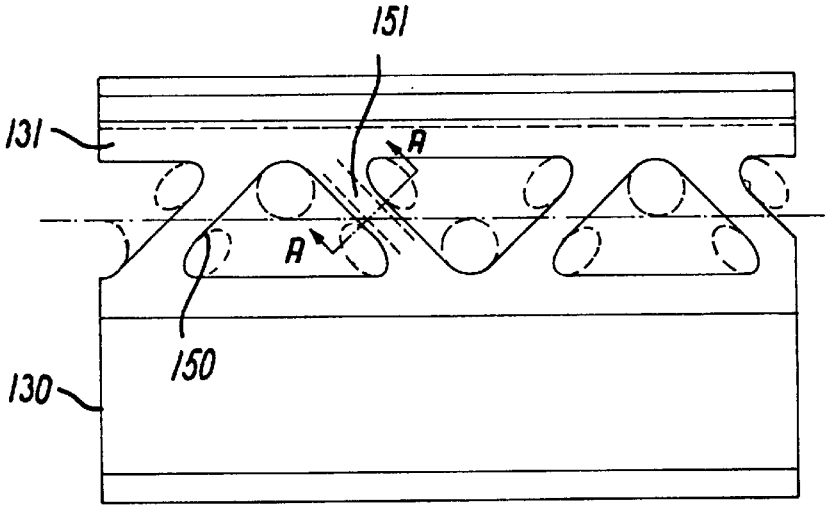
FIG. 7
FIG. 8
FIG. 9
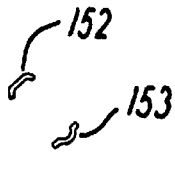

PANEL SYSTEM

The present invention relates to a panel system for construction of a panel fillet or a major panel surface to be mounted in a pitched roof or in a facade, comprising a number of fixed panels together with a number of openable panels, each panel comprising a frame structure composed of frame members bordering a panelling element between them, each frame member comprising a profile element and at least a core element.

Such panel systems are known in many different designs, and at their construction, it is in particular important that both production and mounting are as inexpensive, flexible and efficient as possible.

DE utility model no. G 77 18 436.2 and EP patent no. 553 688 disclose profiles designed to form part in the frame structure of e.g. windows, panels or doors.

In such constructions, the load on the frame varies in the different frame members. Especially in panel fillets or light bands with windows arranged in pitched roofs, the frame members usually extending in the direction of the roof pitch, i.e. the side members of a rectangular frame structure, are required to have larger strength and rigidity than e.g. the bottom members, in particular when the span is large. As the frame members are usually desired to have the same form as regards cross-section dimensions etc., the frame structure is dimensioned according to the demands made to the side members, e.g. making the bottom member more rigid than actually required. This entails an unnecessarily heavy material consumption.

Therefore, the object of the present invention is to improve a panel system of the kind mentioned by way of introduction such that the price of both production and mounting is reduced.

According to the invention, this purpose is achieved in that a panel system as mentioned by way of introduction is characterized in that the profile elements are designed as uniform standard parts, and in that said at least one core element comprises means to vary the moment of inertia of at least some frame members of the frame structure.

By designing the profile elements as uniform standard parts, whereas the variation of the moment of inertia is provided by separate means, the desired uniform geometrical shape is obtained and at the same time, the production of the panel system according to the invention will be less costly than previously known structures, as the use of materials can be optimized in respect of the different demands made on the parts of the frame structure depending on their place in the frame. Furthermore, the panels can be assembled without considering usage of different profile forms independent of whether the panel is to be openable or fixed, which entail a high degree of standardization and an extremely flexible and simple mounting.

In a preferred embodiment, said means comprise at least one element received in the core element and extending over essentially the entire length of the frame member. By this design, the rigidity of the frame members forming part of the individual panels can be varied in a simple way without affecting the exterior geometry of the frame member.

Further advantages can be obtained by the features indicated in the remaining dependent claims.

Figure 2:
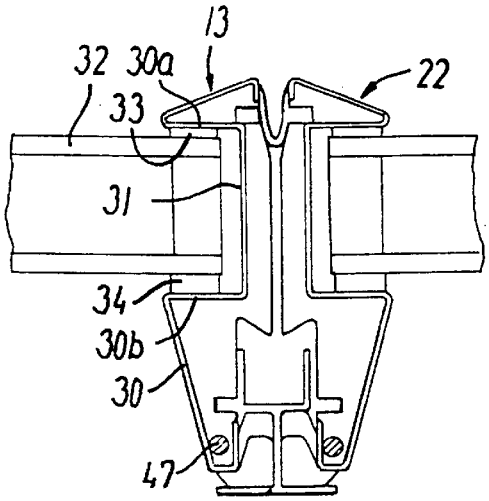
Figure 3:
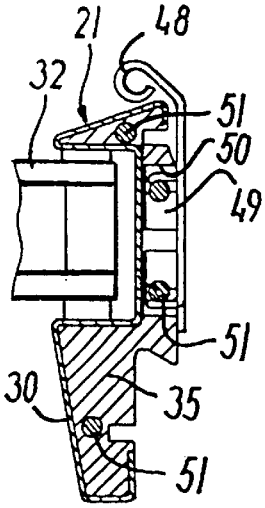
Figure 4:
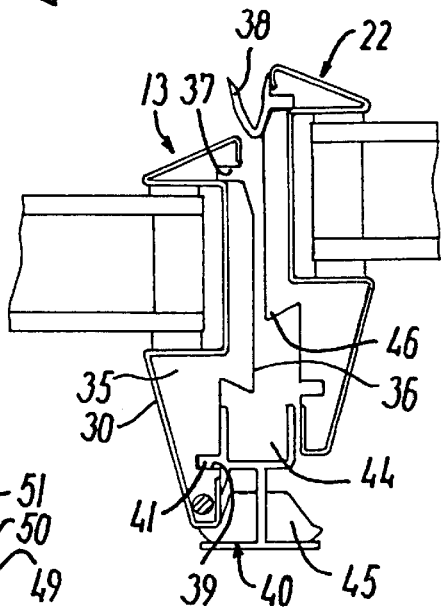
Figure 10:
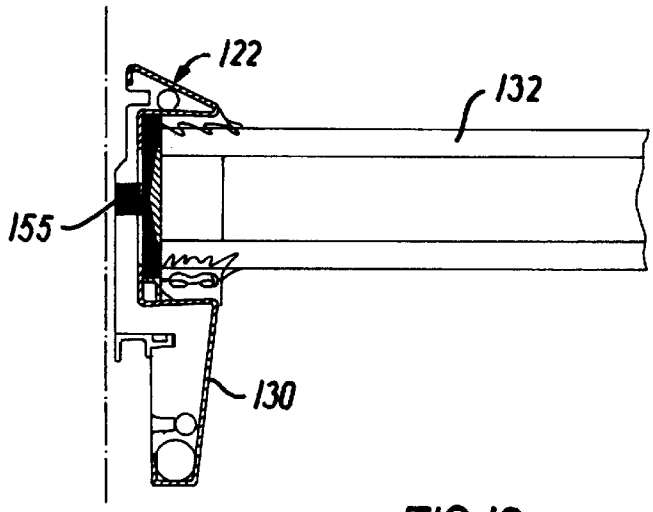
Figure 11:
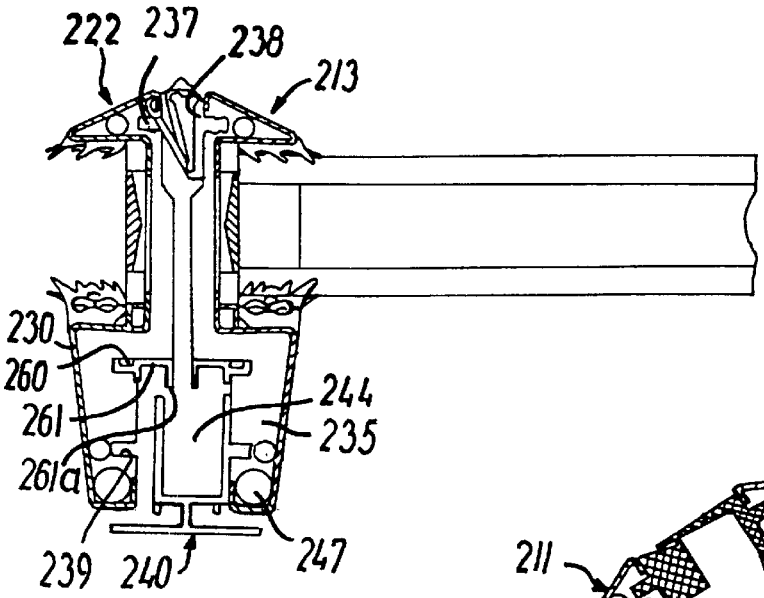
Figure 12:
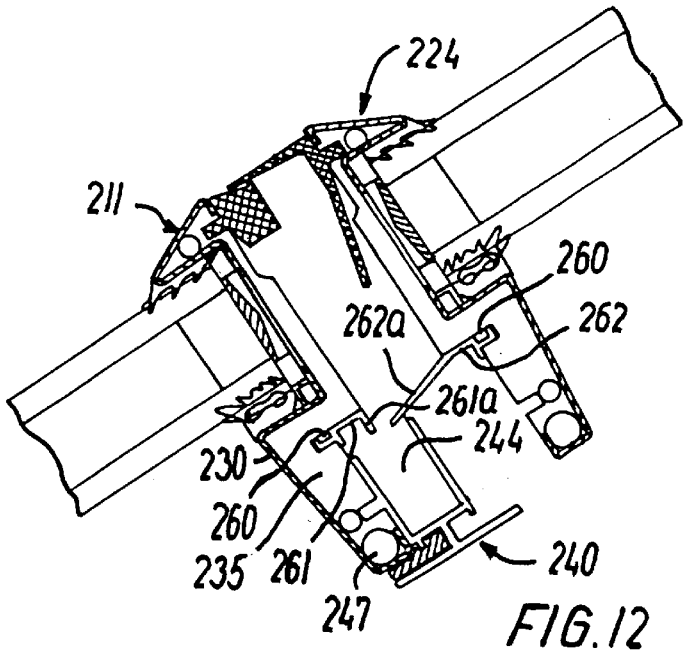

In the following, the invention will be explained in more detail with reference to the schematic drawing, where FIG. 1 shows a section of a panel system according to the invention, FIG. 2 is a sectional view along the line II—II in FIG. 1, FIG. 3 is a sectional view along the line III—III in FIG. 1, FIG. 4 is a view corresponding to FIG. 2 in an open position of the openable panel in the panel system according to the invention, FIG. 5 is a section of a view corresponding to FIG. 2 of an alternative embodiment of the panel according to the invention, FIG. 6 is a perspective view of a profile element in yet another embodiment of the panel system according to the invention, FIG. 7 is a plane view of the variant of the profile element shown in FIG. 6, FIGS. 8 and 9 are sectional views of alternative embodiments of a detail of the profile element shown in FIG. 7 along the line A—A in FIG. 7, FIG. 10 shows a sectional view of an alternative embodiment of the panel system according to the invention, FIG. 11 is a sectional view corresponding to FIG. 2 of a further embodiment of the panel system according to the invention, and FIG. 12 is a sectional view along the line XII—XII in FIG. 1.

FIG. 1 shows a section of a panel system according to the invention which can e.g. be designed to form part of a panel fillet or another major panel surface which in the shown embodiment constitutes at least one part of a glass roof.

The panel system comprises a number of fixed panels 1 together with one or more openable panels 2, in the shown section one. Each panel 1, 2 comprises a frame structure essentially rectangular and with four frame members, i.e. a top member, two side members 13 and a bottom member of the fixed panel 1 and correspondingly a top member 21, two side members 22 and a bottom member of the openable panel 2. The openable panel 2 is at its top member 21 hinged to the subjacent structure in a way that will be described in more detail in the following.

The panels can also be used for many other different geometrical combinations or constructions and may thus have another shape than the shown rectangular one, e.g. a triangular or another polygonal shape for construction of e.g. ridges, double pitch skylight, single pitch skylight and pyramids. The hinged connection can furthermore be arranged at the bottom member of the frame structure or a side member.

The principles of the construction of the frame members will be described with reference to the cross-sectional view shown in FIG. 2 of the frame side members 13, 22 in two adjacent panels 1, 2.

The frame member 13 comprises thus a profile element 30 which in the shown embodiment is designed by roll forming of a metal sheet strip, which may e.g consist of stainless steel. The profile element 30 is provided with a track 31 to receive an edge part of a panelling element which in the shown embodiment is an insulating pane 32, however, which might also be any other panelling element for the panel 1. The insulating pane 32 is in a conventional manner sealed with gaskets 33,34 abutting on a portion 30*a* of the profile element 30 placed above the pane 32 and serving as glazing bead and on a corresponding portion 30*b* placed below the pane 32, respectively. Another possibility (not illustrated) would be to replace one gasket 33, 34 by a glue or silicon joint or a strip-shaped length in order thus to retain the pane 32 to the profile element 30.

With a view to improving the insulating power of the panel system, as shown in FIGS. 6 and 7 which only show the profile element 130 itself without the core element and where parts with the same or analogous function as in the embodiment in FIGS. 2–5 are designated by the same referential numbers plus 100, a portion 131 of the profile element 130 facing the lateral edges of the insulating pane can be provided with a notched pattern comprising a number of openings or notchings 150 separated by bridges 151. The openings 150 are in the shown embodiment essentially triangular, but may have any other geometrical shape. Alternatively, the portion 131 may be provided with major or minor perforations which e.g. can be formed by cutting or punching of the sheet material. The thermal conduction is reduced by breaking the thermal bridge along this portion, at least in part.

By choosing suitable dimensions of these openings or perforations, the moment of inertia and thus the rigidity of the frame members will not be affected to a particularly large extent, and in order to increase the rigidity of the profile element 130 and consequently the entire frame member, there may, as shown by the partial sectional views in FIGS. 8 and 9, in the bridges 151 between the openings 150, be provided embossings 152 alternatively 153 as the shown shapes are merely examples hereof.

In connection with an embodiment of the profile elements comprising such notchings or perforations, the insulating pane 132 can be fixed in a way outlined in FIG. 10. In this embodiment, foam material 155 is injected through the notchings 150 during the production of the panel system, the foam being guided during expansion by means of blocks in order to obtain a scattered fixation of the insulating pane 132 such that the foam does not deform the profile during expansion.

As described with reference to FIGS. 4 and 11–12, the frame member 13 comprises further a core element 35, 235 e.g. constituted by an insulating material, preferably foam of polyurethane (PUR) which is injected and foamed in the metal sheet profile element 30, 230. In order to facilitate the foaming, the side of the core element 35 facing the side frame member 22 of the adjacent panel is in the embodiment shown in FIG. 4 at least partially designed as a backing layer 36 of another material, preferably an insulating material as for instance ABS plastic, and thus constitutes an additional element. Besides improving the insulating power of the window, the core element and the additional element increase the rigidity of the frame member. By a suitable choice of material and placement, it is thus possible to vary the rigidity of a the frame members such that the parts exposed to the largest loads in terms of bending and torsion, i.e. the side members are provided with a larger moment of inertia than the top and bottom members. Furthermore, the usage of a mouldable material in the core element and the additional element, as will be explained in more detail in the following, permits to provide details which will be essentially more difficult to form in the profile element itself.

The shown backing layer 36 is provided with a first track 37 which, as shown for the side frame member 22 of the adjacent panel 2, serves to receive an outer gasket 38, and a second track 39 for receiving a flange part 41 on an interior cover strip 40 carrying an interior sealant strip 45 and which in a top U-shaped portion defines a drain trench 44. Opposite the cover strip 40, the additional element 36, alternatively the core element 35, is provided with a drip cap 46. The tracks 37, 39 can in a manner not shown in detail be provided with ribs for improved securing of the gasket 38 and the cover strip 40, respectively. Since the cover strip 40 is merely provided with a flange portion 41 in one side and otherwise is designed symmetrically, it may be reversed such that the flange portion 41 projects in the track 39 in the side frame member 22 of the right panel 2 in FIGS. 2 and 4, if it is desired to make the left panel 1 openable and the right panel 2 fixed. Especially for aesthetic reasons, a not shown cover element with design and colour chosen by the client may be arranged on the cover strip 40 in order that this cannot be seen from the inside.

In the embodiment in FIGS. 11 and 12, where parts with the same or analogous function as in the embodiment in FIGS. 2–4 carry the same referential number added with 200, an additional track 260 has been formed in the core element besides the tracks 237, 239, in which track a separate drip cap element 261, 262, respectively, is received. The separate drip cap element 261 and 262, respectively, can e.g. be designed as a profile inserted in the track 260 by means of any suitable releasable securing principle. In the frame members 222, 213 shown in FIG. 11 constituting adjacent frame members of two juxtaposed panels, an element 261 is provided in each frame member, and the drip cap elements have an outer flange portion 261*a* which is essentially flush with the edge of the core element 235 and which is to assure that water that may penetrate past the external sealant strip 238 is led down in the drain trench 244 of the cover strip 244. In the joint between superimposed panels shown in FIG. 12, the drip cap element 262 inserted in the track 260 of the top frame member 211 is also provided with an outer flange portion 262*a*, however, with an essentially increased length in relation to the flange portion 261*a* on the drip cap element 261 in the lower frame member, in order to assure that the water is led down to the drain trench 244. The design of the drip cap element can be variated, among other in dependence of the position in the panel system. Thus, a membrane can be received in the track 260 at the top member of an openable panel.

It is to be understood that the said core element designed as an insulating part of the frame member could be designed in any other appropriate way, e.g. by extrusion of a length of a suitable material which is subsequently pressed into the metal profile element 30 and secured to this by e.g. gluing or form locking within the flange portions of the profile element 30. As an alternative, a form part can be used in connection with the element of PUR foam.

Furthermore, the profile element 30 itself can during the production be provided with corresponding tracks or other engagement means for receiving the sealant strip, cover strip and drip cap element(s). The profile element can further be produced in other ways and of other materials than by roll forming of a steel plate strip, e.g. by extrusion of an aluminium profile or pultrusion of a carbon fibre reinforced fibre glass profile.

In the shown embodiments, at least in the frame members extending in the direction of the roof pitch, means are arranged to provide the frame member with increased rigidity. These means are in the embodiment in FIGS. 2–4 designed as a stiffening element 47 which in the shown embodiment is a stainless thread positioned in the bottom part of the frame member 13. This element 47 extending over essentially the entire length of the frame member permits to provide the frame member with the necessary rigidity as the moment of inertia of the frame member can be varied as desired by a suitable choice of material and diameter of the thread. Other appropriate materials of the stiffening element are fibre enforced materials as e.g. glass fibre and/or carbon fibre perhaps in a polyester matrix. In the embodiment in FIGS. 11 and 12, a stiffening element 247 is provided.

As appears from FIGS. 2 and 11–12, the side frame members 22 of the openable panel 2 is constructed in the same way as the one in the above described side frame member 13 of the fixed panel 1. Correspondingly, it applies that the general design of the profile elements of the frame members are the same for the top, bottom and side members of both fixed and openable panels, whereas the choice of material composition and design of the workable material filling out the profile element can be varied from frame member to frame member as the side members in a rectangular frame structure will, however, be designed in a mutually alike way.

From FIG. 3 further appears that the top frame member 21 in the shown embodiment is hinged with the subjacent structure by means of a hinge mounting 48 fixed to the frame member 21 by means of a mounting 49 in a recess 50 designed for the purpose in the first core element shaped as an insulating element 35. The mounting 49 is connected to the two middle elements of a total of four elements 51 which are designed as gussets in the form of bent reinforcing steel extending along the top member and down in each side member. In this way, the securing forces are transferred to the side members of the frame structure. Other forms of gussets are obviously also conceivable. The hinged connection can of course also be designed in any other way imaginable.

FIG. 5 shows an alternative embodiment of a frame member where a portion 30*a*' of a profile element 30' placed above the insulating pane 32 is designed as a separate list. The separate list 30*a*' is connected with the profile element 30' in that this is provided with a folding 30*c*' which upon placement of the insulating pane 32 in the pane track can be brought into engagement with the list 30*a*' by e.g. snap locking.

The invention is not limited to the above described embodiments. By way of example the profile elements and the core elements may have other forms than the ones shown, and the stiffening element can be placed elsewhere in the cross-section of the frame member.

What is claimed is:

1. A panel system for construction of a panel fillet or a major panel surface to be mounted in a pitched roof or in a facade, comprising a number of fixed panels (1) together with a number of openable panels (2), each panel comprising a frame structure composed of frame members (13, 21, 22; 122; 213; 222) bordering a paneling element (32) between them, each frame member comprising a profile element (30;130;230) and at least one core element (35; 135; 235), characterized in that the profile elements (3) are designed as parts having the same exterior shape as one another, and in that said at least one core element comprises means to vary the rigidity of at least some frame members of the frame structure.

2. A panel system according to claim 1, characterized in that said means comprise at least one element (47;247) which is received in said core element (35;235) and which extends over essentially the entire length of the frame member.

3. A panel system according to claim 2, characterized in that said element (47) is a stainless thread.

4. A panel system according to claim 2, characterized in that said element is designed as a fibre enforced material.

5. A panel system according to claim 1, characterized in that said core element (35) is produced of an insulating material, e.g. polyurethane foam (PUR).

6. A panel system according to claim 1, characterized in that the frame members (13, 21,22) comprise an additional element (36), preferably of ABS plastics, which together with the profile element (30) form a closed cavity in which said core element (35) is received.

7. A panel system according to claim 1, characterized in that the profile element (30) or said core element or said additional element (35,36) are provided with engagement means, preferably comprising at least one track (39), for releasable securing of an interior cover strip (40).

8. A panel system according to claim 1, characterized in that the profile element (30) or said core element or said additional element (35,36) are provided with engagement means, preferably comprising at least one track (37), for releasable securing of a corresponding number of sealing strips (38).

9. A panel system according to claim 1, characterized in that the profile element (230) or said core element or said additional element are provided with engagement means, preferably comprising at least one track (260), for releasable securing of a separate drip cap element (261,262).

10. A panel system according to claim 1, characterized in that a portion (131) of the profile element (130) facing said panelling element (132) is provided with a multitude of openings (150) in the form of notchings of perforations.

11. A panel system according to claim 10, characterized in that the panelling element (132) is secured in the profile element (130) by means of a foam material (155) injected through said openings (150).

12. A panel system according to claim 1, characterized in that a portion (30*a*')) of said profile element (30') placed above the insulating pane (32) is designed as a separate list in releasable connection with the remaining part of the profile element (30*c*').

13. A panel system according to claim 1, where the frame structure is essentially rectangular with side members extending in the direction of the roof pitch or the elevation of the facade, characterized in that said means are arranged in the side members of the frame structure.

14. A panel system according to claim 4, wherein the fibre enforced material is fibre glass in a polyester matrix.

15. A panel system according to claim 4, wherein the fibre enforced material is carbon fibre in a polyester matrix.

* * * * *